US005462218A

United States Patent [19]

Grigsby et al.

[11] Patent Number: 5,462,218

[45] Date of Patent: Oct. 31, 1995

[54] CLEATED CORRUGATED PAPERBOARD CONTAINER

[76] Inventors: John M. Grigsby, 2275 Edgemere Lake Cir., Marietta, Ga. 30062; Daniel H. Doerr, 4794 Boxwood Way, Acworth, Ga. 30102

[21] Appl. No.: 317,038

[22] Filed: Oct. 3, 1994

[51] Int. Cl.[6] ..... B65D 5/50

[52] U.S. Cl. ..... 229/23 C; 229/103.2; 229/23 R; 206/320; 206/594

[58] Field of Search ..... 206/319–321, 206/553, 591, 594; 229/23 R, 23 C, 103.2

[56] References Cited

U.S. PATENT DOCUMENTS

| | | | |
|---|---|---|---|
| 2,488,692 | 11/1949 | Talbot | 217/12 |
| 3,099,351 | 7/1963 | Coffey, Jr. | 206/320 |
| 3,136,472 | 6/1964 | Waller et al. | 229/23 |
| 3,481,457 | 12/1969 | Overton, III et al. | 229/23 R |
| 3,486,612 | 12/1969 | Kivell | 229/23 R |
| 3,680,688 | 8/1972 | Smith | 206/320 |
| 3,757,935 | 9/1973 | Coons et al | 229/23 R |
| 3,773,171 | 11/1973 | Edsall | 206/320 |
| 3,845,859 | 11/1974 | Dornbush | 229/23 R |
| 3,918,580 | 11/1975 | Peggiali | 229/23 R |
| 3,999,658 | 12/1976 | Anderson | 206/320 |
| 4,186,834 | 2/1980 | Krack | 229/23 R |
| 4,792,041 | 12/1988 | Grigsby | 206/319 |
| 4,832,256 | 5/1989 | Grigsby | 229/23 |
| 5,183,155 | 2/1993 | Vaura | 206/320 |

FOREIGN PATENT DOCUMENTS 311983 5/1929 United Kingdom .

OTHER PUBLICATIONS

North American Container Corp. Brochure "Wood Cleated Corrugated" 7 pages.

*Primary Examiner*—Gary E. Elkins
*Attorney, Agent, or Firm*—Kennedy & Kennedy

[57] ABSTRACT

A cleated corrugated paperboard container is disclosed having a blank of corrugated paperboard scored to define panels for folding to define a container that wraps around a cast iron bathtub having a well with a rim surface and an apron extending along the side of the well from an edge of the rim. Cleats rigidly attach to the side edges of the panels to define a load bearing frame at the ends of the container.

9 Claims, 2 Drawing Sheets

CLEATED CORRUGATED PAPERBOARD CONTAINER

TECHNICAL FIELD

The present invention relates generally to cleated corrugated paperboard containers. More particularly, the present invention relates to cleated corrugated paperboard containers for packing, shipping, and storing cast iron bathtubs.

BACKGROUND OF THE INVENTION

The packaging of large heavy articles presents a number of problems for manufacturers. Residential and commercial cast iron bathtubs are one type of such articles that require special attention for packaging for shipping, storing, and handling. Cast iron bathtubs are heavy, typically weighing up to 400 pounds, and are easily subject to damage if mishandled. Cast iron tubs have porcelain finish surfaces which may be easily scratched, cracked, or chipped if the tub or its container is mishandled. Cracks and chips allow water to contact the cast iron substructure of the tub and can result in discoloration due to rusting. This type of damage is not easily repaired either at the factory or at the receiving destination. Competition for sales among manufacturers and low profit margins associated with cast iron tubs require manufacturers to give particular attention to the packaging and to the tubs held in the packaging. Bathtubs are typically closely inspected at the manufacturing facility before packaging so that tubs with surface defects are not shipped to customers. Reputation for quality products accordingly depends on the tubs being delivered to destinations without defects created during shipping, storage, or handling.

The packaging, or containers, for cast iron tubs must meet several competing needs. Containers typically are not a value-added feature for articles, and the costs are directly added to the costs of the articles. Containers should therefore be made of relatively low cost materials. Such materials, however, may not be sufficient for meeting the structural and protective needs of containers for heavy articles.

The containers for cast iron tubs must have sufficient structural strength to contain the heavy cast iron tub while being transported. The containers must withstand the vibrations typically associated with motor freight and rail shipment. These transportation systems incur sudden starts and stops, rough road conditions, and handling forces that subject the containers to extreme stresses. The containers must absorb such stresses without causing damage to the tubs. Handling tools such as clamp trucks, forklift trucks, and dollies are typically used to move the contained products between storage and shipping vehicles. These grip, pickup, and move containers forcefully, and containers may be pierced, pinched or broken during handling. A broken container risks damage to the contents.

Bathtubs are transported with the tubs positioned either vertically or positioned horizontally. In the vertical position, the tubs are positioned in containers that stand on one end. The shape and weight distribution of the tub prevents it from standing unsupported on the end. Therefore the container itself must support and restrain the tub from tipping over during handling, storage, and shipping. In the horizontal position, the tub is typically packaged upside down. Shipping and handling tubs horizontally may create abrasion damage to the rim surface of the tub. The cleating for the container must have sufficient strength and be sufficiently fixed to the walls of the containers so as to not break or pull loose in response to the forces encountered during handling, stacking and warehousing. Cast iron tubs are often handled and shipped vertically due to the improved space utilization and reduction of abrasion of the porcelain rim surface of the tub.

Containers for cast iron tubs must also have sufficient compression strength so that the containers may be stacked one above another to have more efficient utilization of warehouse storage space. Often containers of bathtubs are stacked four or five units high. The cost of space for finished-goods warehousing is thereby minimized as higher ceiling buildings hold more product per square foot of floor space than if the goods are not stackable. Such stacking conditions, however, may impose loads of up to 1600 pounds of force on the lowermost unit in the stack.

The container for packaging heavy consumer goods such as bathtubs therefore faces the competing requirements of low cost materials yet relatively high structural strength. Presently, cast iron tubs are packaged in a wirebound container. Thin wooden slats are joined to thicker wood cleats by staples to form open-sided panels for a crate. The panels are connected together by bailing wire which is stapled to the wood cleats. Such wirebound containers have adequate strength for handling and shipping, but have several disadvantages which limit their practical use presently and in the future. One known manufacturer produces porcelain bathtubs at a rate of about 480 bathtubs per eight hour shift. The shipping containers must be simple and easily set up for insertion of the tub. The stiff wires make these wirebound containers awkward to handle when packaging a finished bathtub. Difficulty in assembling the containers and in packaging bathtubs in assembled containers can result in production line slow down and loss of production.

The nature of the wood and wire materials makes disposal of the wirebound containers difficult after use. The wire is rigidly attached to the wood, and separating the wire from the wood is laborious and time consuming. Typically, landfills are the only disposal method for such wire bound crates. There are a number of environmental factors which limit the availability of landfills for disposing of wirebound containers, including the shortage of available landfill space, pressures from government and environmental groups regarding use of landfills, and the associated increasing costs of disposing of materials in landfills. The wirebound crates also may create quality problems for cast iron tubs. The crates typically are open which allow grit and dust to settle on the surface of the tub. Objects can fall or be pushed against the tub surface. The grit and objects can result in damage to the porcelain finish, and at the least, cause an unsightly appearance of the tub at the showroom or at installation in a bathroom. Surface repairs are difficult and in practice may result in a more unsightly appearance for the bathtub.

There are other factors that limit the use of these wirebound containers. Printing of information is impractical on the wood surfaces of the wirebound containers. The limited surface area offers little, if any, potential for advertising or graphics to attract consumers to the product. The use of wirebound containers may also pose hazards for persons handling the containers due to the potential of the wood for splinters and the wire for staple pricks and cuts. Recently the supply of container-grade wood is being reduced, and this increases the cost of such wood. Further, the number of manufacturers of such wirebound containers is declining. These factors result in difficulties with supply and increased costs for manufacturers of products shipped in wirebound containers.

Accordingly, there is a need in the art for a low cost, high strength container for holding and protecting cast iron tubs during shipping, storage and handling.

BRIEF SUMMARY OF THE INVENTION

The present invention comprises a cleated corrugated paperboard container for enclosing a cast iron bathtub conventionally having a well with a rim surface extending around an opening of the well and an apron extending along side of the well from an edge of the rim. The container foldably assembles from a flattened blank of corrugated paperboard scored to define a top panel, an apron panel, a bottom panel, and a well panel as a series of panels and a manufacturers joint foldably joined together along the respective scores. The blank has two side edges, a leading edge, and a trailing edge. A pair of cleats rigidly attach along the side edges of each of the panels in the series of panels, whereby a plurality of cleats are longitudinally aligned on the side edges of the blank. Each cleat has a pair of longitudinal ends which are cut for mating engagement with the end of the adjacent cleat. A pair of rim-support pads are rigidly attached to the bottom panel, and each one of the pair abuts an inner side of a respective one of the cleats. A pair of apron pads are spaced-apart and rigidly attached to the apron panel for cushioning the apron of the bathtub held within the folded blank that forms the container. A pair of feet pads are spaced-apart and rigidly attached to the top panel such that a surface of the respective feet pads contact at least one foot extending outwardly from a bottom surface of the well of the bathtub held within the folded container, for restricting the feet of the bathtub from punching through the top panel of the blank. The blank, being folded on the scores after the bathtub is placed rim down on the rim-support pads, encloses the bathtub in a corrugated paperboard container which is then closed by securing the manufacturers joint to a portion of the top panel adjacent the trailing edge of the blank.

DETAILED DESCRIPTION OF THE PREFERRED EMBODIMENT

Figure 1:
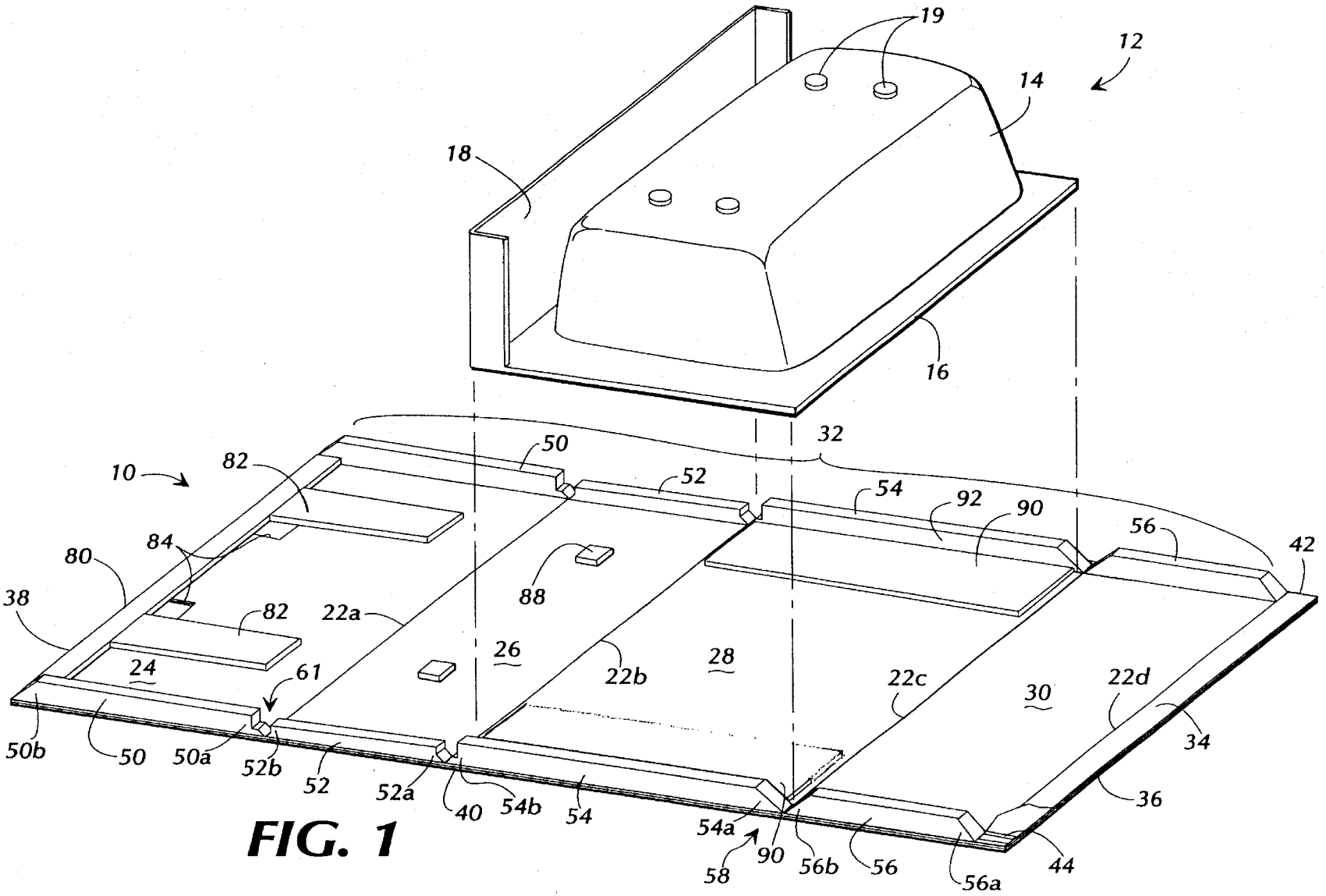
FIG. 1 is a perspective view of a blank of corrugated paperboard defining panels of a container for enclosing a cast iron bathtub.

Referring now in more detail to the drawings, in which like numerals indicate like parts throughout the several views, FIG. 1 is a perspective view of a blank 10 of corrugated paperboard for holding a cast iron tub 12 illustrated exploded from the blank. The cast iron tub is illustrated upside down for placement on the blank 10, as discussed below. The tub 12 includes a well 14, a rim surface 16 that extends around an opening of the well (not illustrated), and an apron 18 that extends along side of the well from an edge of the rim 16. A bottom surface of the tub 12 has a plurality of spaced-apart feet 19.

The blank 10 of corrugated paperboard includes a plurality of spaced-apart scores 22 that define a top panel 24, an apron panel 26, a bottom panel 28, and a well panel 30 as a series 32 of panels, and a manufacturer's joint 34 foldable joined together along the respective scores 22. The blank 10 has a leading edge 36, a trailing edge 38, and two side edges 40 and 42.

A pair of reinforcement ribbons 44 are illustrated in cut-away view. The ribbons 44 are preferably imbedded between plies of the corrugated paperboard forming the blank 10. The ribbons 44 extend the length of the blank 10 from the leading edge 36 to the trailing edge 38. The pair of ribbons 44 preferably are spaced-apart and disposed in a portion of the blank 10 adjacent the respective side edges 40 and 42.

Pairs of cleats 50, 52, 54, and 56 rigidly attach to each panel 24, 26, 28, and 30, respectively, in the series 32 of panels on a portion of the respective panel adjacent the side edges 40 and 42. In the illustrated embodiment, a side face of each cleat 50, 52, 54, and 56 is flush with the respective side edges 40 and 42. The pairs of cleats rigidly connect to the panels with glue and staples. The glue is preferably a cold setting, water-based glue, such as PVA. The staples hold the cleats in contact with the corrugated paperboard blank 10 until the glue sets. The staples also reinforce the bonding of the cleats to the paperboard body. Other methods of attachment could be used, such as fast setting hot melt adhesives, although such are less recyclable and more costly.

The cleats 50, 52, 54, and 56 are thereby longitudinally aligned on the respective side edges 40 and 42 of the blank 10. Each cleat 50, 52, 54, and 56 has a pair of longitudinal ends which for convenience are designated with characters a and b for the respective cleat. The character a identifies the end of the respective cleat closest to the leading edge 36. The character b identifies the end of the respective cleat closest to the trailing edge 38. Each cleat end is cut for mating engagement with the respective end of the adjacent cleat. The cleats 50, 52, 54, and 56 are positioned on the panels such that the ends are offset approximately 1/16 inch from the center of the respective score 22. This spacing provides allowances for folding the blank 10 to form the container. The offset may be greater depending on the thickness of the corrugated paperboard in the blank 10 and the width of the score 27.

In the preferred embodiment, the cleats 50, 52, 54 and 56 are made of hardwood. However, other materials of sufficient density, stiffness and hardness could be used instead of wood. One such material is FIBRE/CORE boards available from North American Container Corporation, Atlanta, Ga. These boards are made of compressed solid fiber paperboard and corrugated paperboard sheets which are laminated together with adhesive and the sides of the boards are capped to provide rigidity and strength. Use of this material for the cleats provides an advantage in recycling the container after the tub is removed for installation or display. Solid fiber paperboard and corrugated paperboard can be recycled in conventional paper plant hydrapulpers which use heated water and agitation to break corrugated paperboard into fibrous pulp for remanufacture into recycled paperboard. The cold glue and the staples used to attach the cleats 50, 52, 54, and 56 are reprocessable through hydrapulper recycling units. The hot water and agitation dissolves the glue, and the staples settle out and are collected on a scavenger screen.

Figure 2:
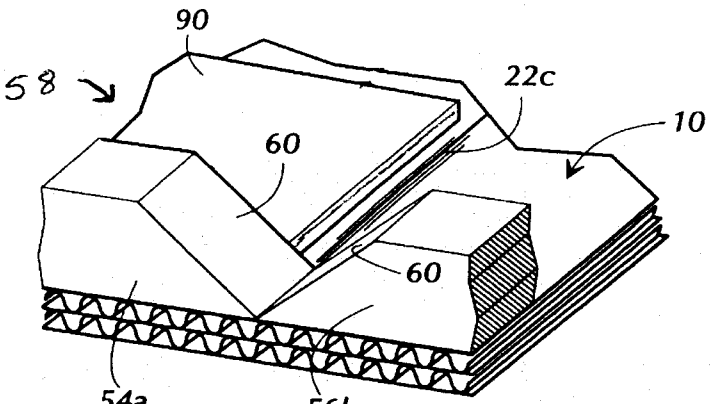
FIG. 2 is a perspective view of a joint between adjacent cleats attached to the blank illustrated in FIG. 1.

FIG. 2 is a detailed illustration of a joint 58 between the cleat ends **54*a* and 56*b* attached to the blank 10. The respective ends 54*a* and 56*b* each have a bevel face 60 cut in the end of the cleat 54 and 56 for mating engagement when the blank 10 is folded to form the container, as discussed below. The cleat ends 50***b* and 56*a* similarly have bevel faces 60 for mating engagement upon folding the blank 10 to form a second joint 58 for the container for the cast iron tub. The angle of the bevel faces 60 are determined by the final shape of the "set-up" container discussed below so as to tightly enclose and restrict the tub 12. The angle of the bevel faces 60 typically ranges from about 35 to 55 degrees.

Figure 3:
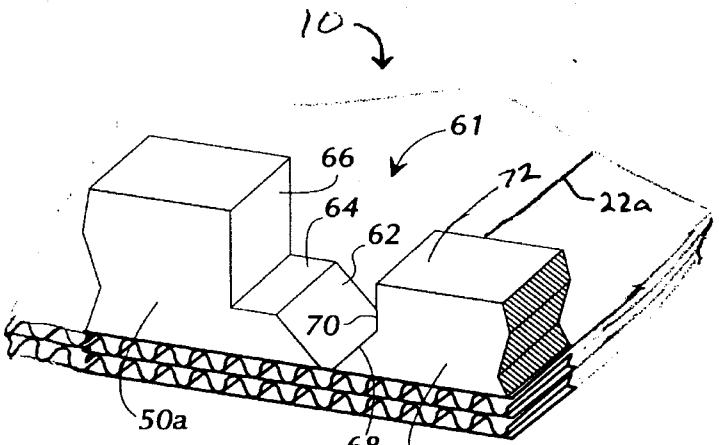
FIG. 3 is a perspective view of a second joint between adjacent cleats attached to the blank illustrated in FIG. 1.

FIG. 3 is a detailed perspective view of a joint 61 formed between the cleat 50 and the cleat 52. The end 50*a* is cut to define a bevel face 62, a horizontal seat 64 and a vertical side 66. The end 52*b* is cut to define a mating beveled face 68 and a vertical face 70. The cleat 52 has an upper surface 72. As discussed below, folding the blank 10 on the score 22*a* brings the two ends 50*a* and 52*b* together to form the joint 61. The bevel faces 62 and 68 come together in mating contact. The seat 64 abuts the face 70 and the side 66 contacts the upper surface 72 to thereby form the rigid joint 61 for transferring shock and load imposed on the container during shipping, handling, and storage. The cleat ends 52*a* and 54*b* similarly form a reversed one of the joints 61. The end 54*b* includes the bevel face 62, the seat 64, and the vertical side 66 while the end 52*a* includes the bevel face 68 and the vertical face 70. The joints 61 allow shock forces from an external impact such as during shipping or handling to be transmitted through the container instead of into the apron 18 where damage can occur. The beveled faces 62 and 68 are preferably cut at 45 degree angles since the apron panel 26 is folded perpendicular to the bottom panel 28 and the top panel 24 is folded perpendicular to the apron panel, as discussed below, to form the container. A shock force impressed on the well panel 30 is transmitted through the cleats 50 and 54 to the cleat 52. The squared neck of the joints 61 prevent the panels 24 and 28 from displacing with respect to the bevel faces 62 and 68, which would permit the shock force to be transmitted to the apron 18.

With continued referenced to FIG. 1, a joint cleat 80 is rigidly attached to the top panel 24 along the trailing edge 38 of the blank 10. The cleat 80 is disposed transverse between the sides 40 and 42. A pair of feet pads 82 rigidly connect to the top panel 24. The feet pads 82 are disposed on the top panel 24 for contact with the feet 19 of the tub 12 when the blank 10 is folded to form the container. The top panel 24 further defines a pair of openings 84 for inspection of the tub after packaging and for a hand grip when moving the loaded container.

The apron panel 26 includes apron pads 88 which are spaced-apart on the apron panel. The apron pads 88 cushion the apron 18 of the tub 12 when the container is foldably assembled. The apron pads 88 are preferably made of expanded polystyrene material, although corrugated paperboard pads may be used.

The bottom panel 28 includes a pair of rim support pads 90 of corrugated paperboard. The rim support pads 90 abut a side face 92 of the respective cleat 54 and are attached with adhesive to the bottom panel 28. In the illustrated embodiment, the rim support pads 90 extend the width of the bottom panel 28 to provide support for side portions of the rim 16 of the tub 12. The rim support pads 90 add to the thickness of the corrugated paperboard skin covering the side rim portion of the tub 12. The pads 90 provide cushioning and shock protection for the side rim portions of the tub 12 which is vulnerable to damage during handling, storage, and shipping. In a preferred embodiment, the pads 90 are made of a double thickness of double wall corrugated paperboard. The pads may be coated with anti-abrasive coatings common to the container industry.

Figure 4:
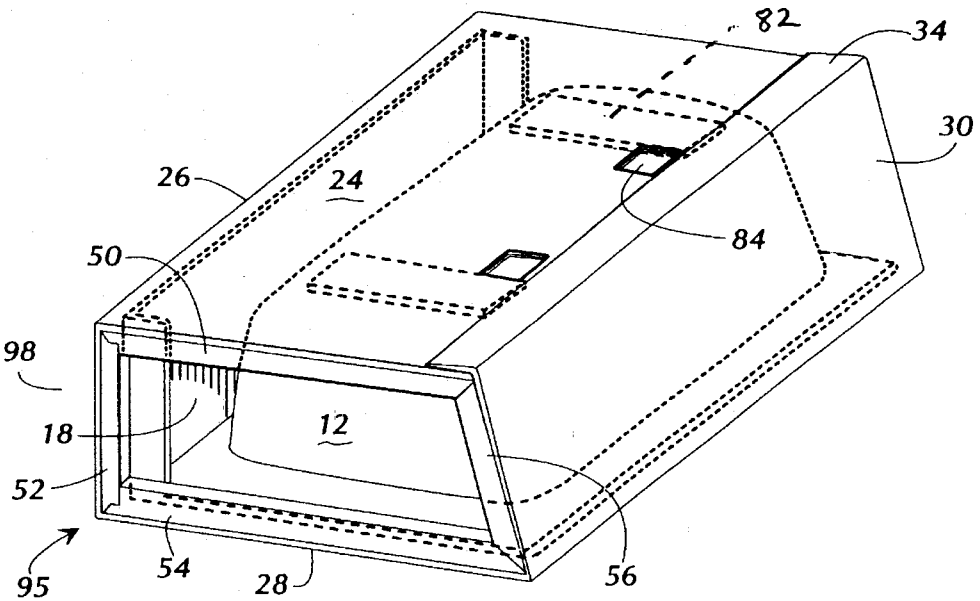
FIG. 4 is a perspective view of the blank of corrugated paperboard illustrated in FIG. 1, folded to enclose a cast iron bathtub.

The blank 10 accordingly provides a foldable container 95 for enclosing the bathtub 12, as illustrated in FIG. 4. An end generally designated 98 is shown; the opposite end of the tubular container 95 is a mirror image. The trapezoidal shape of the container 95 in the illustrated embodiment is dictated by the apron-style bathtub 12. The container 95 for other style bathtubs, such as a bathtub with two aprons, has a rectangular shape. The trapezoidal shape allows the cleats 50, 52, 54, and 56 to interlock at the ends of the container. The interlocking cleats provide rigidity and strength so that the container and the cast iron tub withstand shipping, handling and storage. The cleats restrain the tub in place within the container.

The corrugated paperboard used for the blank 10 is determined by the weight of the product being packaged, the handling and shipping methods, and warehouse stacking requirements. In a preferred embodiment, a paperboard of 400 test double wall sheeting, standard in the container industry, is used, although other weights commonly referred to as tests could be used. The double wall corrugated paperboard material comprises three flat sheets or liners separated and laminated to two centrally located fluted layers of paperboard, called mediums, which are conventionally manufactured on a corrugator that combines liners and mediums in a high speed process. The corrugated paperboard sheet of the blank 10 is scored, slotted and printed to fit the particular tub on a conventional printing press used in the corrugated container industry. Such presses feed the flat sheets of corrugated paperboard through a series of rotary cylinders to which are attached scoring heads and printing dies for scoring, slotting and printing the sheet. The corrugated paperboard blank 10 may be coated with waterproofing material, which coatings are common to the industry, and include wax and synthetic coatings. Such coatings incur additional costs and lessen the recyclability of the paperboard. For these reasons, a preferred embodiment does not use waterproofing coatings.

To enclose a tub, the blank 10 is first laid flat as illustrated in FIG. 1. The tub 12 is moved off of its assembly line and placed upside down on the rim support pads 90 such that the rim corners of the tub 12 are adjacent respective ends of the cleats 54. The pads 90 provide cushioning for the rim surface 16. The cleats 54 extend upwardly from the rim support pads 90 to define the side face 92. The longitudinal ends of the tub 12 abut the faces 92. The cleats 50, 52, 54, and 56 are preferably thicker than the rim 16 of the tub 12. The cleats keep the tub 12 from sliding longitudinally out of the ends of the tubular container 95. Typically the thickness required ranges from about 1 inch to 1.75 inches, depending on the design of the tub.

The blank 10 is then folded along the score 22*b* to bring the apron panel 26 upwardly against the apron 18 of the tub 12. This forms the interlocking joint 61 between the ends of the cleats 52 and 54. The bevel faces 68 and 62 of the ends 52*a* and 54*b*, respectively, are moved into mating contact. The seat 64 abuts the face 70 and the side 66 contacts the upper surface 72, to thereby form the rigid joint 61. The beveled faces 62 and 68 are preferably cut at 45 degrees since the panel 26 is perpendicular with respect to the bottom panel 28. A shock force impressed on the apron panel 30 is transmitted through the cleats 50 and 54 to the cleat 52. The squared-off neck of the joint 61 prevents the top panel 24 and the bottom panel 28 from displacement which otherwise would permit the shock force to be transmitted to the apron 18 of the tub 12.

In contrast, the joints 58 between the cleat ends 50*b* and 56*a* and between the cleat ends 54*a* and 56*b* are simple bevel cuts. Known bathtubs have adequate strength on the side opposite the apron to absorb such impacts. Packaging costs are lessened by using the simple bevel cut instead of a more complicated joint that may require special tenoning machines to manufacture the cleat ends. The pads 88 cushion the side of the container against the apron 18.

The top panel 24 is then folded along the score 22*a* over the edge of the apron 18 against the bottom of the well 14. This forms the joint 61 between the cleats 50 and 52, as discussed above. The feet pads 82 contact the feet 19 of the tub 12. The feet pads 82 prevent the feet 19 from punching through the corrugated paperboard panel 24.

The apron panel 30 is then folded upwardly along the score 22*c* to bring the faces 60 of the cleats 56 and 54 into engagement. The manufacturer's joint 34 folds along the respective score 22 over the top panel 24. The manufacturer's joint is rigidly connected to the top panel 24 with adhesive. The manufacturer's joint allows the leading end 36 and the trailing end 38 of the paperboard blank 10 to be joined or finished once the blank is folded around the bathtub 12. Cold adhesive is applied to an outside surface of the top panel 24 adjacent the trailing edge 38. The cold adhesive is conventionally applied with a compressed air-operated glue applicator head. The manufacturer's joint 36 is folded down against the glued outer surface of the top panel 24. Staples may also be driven through the manufacturer's joint 34 into the joint cleat 38 to rigidly secure the container 95 in a wrapped enclosure around the tub 12. A preferred staple has a crown of about one inch width and a leg length sufficient to penetrate about ⅞ of a thickness of the underlying cleat so that the holding strength of the staple can be utilized without the points of the staples penetrating the outer surface of the cleat. The panel 30 defining the manufacturer's joint is preferably crushed during manufacturing so that the outside joint formed when packing the cast iron tub 12 protrudes less than if the corrugated paperboard were not crushed.

The enclosed tub is held within the container 95 formed by folding the blank 10 as discussed above. The openings 84 in the top permit inspection of the tub 12 held in the container. The openings 84 further provide hand grips for grasping the container during shipping and handling. The cleats 50, 52, 54, and 56 act as a bracing structure, as described above, for shipping, handling and storing of the container. The cleats also provide end-to-end stacking strength when the container is stacked vertically. For this reason, it is preferred to have the flutes of the corrugated paperboard blank 10 oriented parallel to the leading edge 36.

The reinforcing ribbon 44 is preferably made of a plastic material with a high tensile strength. The reinforcing ribbon 44 prevents tearing of the corrugated paperboard 10, especially at the score lines 22, when the container holding a tub 12 is handled manually. For example, plumbers at a building site typically carry the tub 12 in the container 95 by manually lifting from the ends and gripping under the cleats 50 or 54 depending on which side the container is resting. In handling the container 95 in this manner, the weight of the tub 12 is transmitted to the downward surface of the container. The reinforcing ribbon 44 reinforces the corrugated paperboard at the scores 22 which join the load bearing surface to the apron panel 26 and the well panel 30 that define the sides of the container 95. In a preferred embodiment, the reinforcing ribbons 44 are located adjacent the side edges 40 and 42 between the inner two liners and mediums in a double wall construction. The reinforcing ribbons 44 thus act as a girdle that encases the corrugated paperboard container 95 and the edge cleats 50, 52, 54, and 56 to reinforce the container and to provide additional safety for manual lifting of the enclosed tub 12 at the job site.

The cleated corrugated container described above meets the needs for a container for cast iron tubs. The heavy double wall corrugated paperboard body provides rack and torquing stability for the clearing, and provides a printable surface for the manufacturer's advertising, model numbers and the like. The cleating is internal to the corrugated body, which reduces the potential for injury due to splinters and staple pricks. The cleats are fixed to the corrugated paperboard body in such position to restrain the tub from movement in shipment, and to provide the necessary warehouse stacking strength and protective requirements. The cleated corrugated paperboard container described herein is more easily set up than the stiff wirebound crate, which reduces pack line labor and fatigue and facilitates automation of the packing process. The cleated corrugated paperboard container knocks down flat and stacks with others for bulk shipping from the container manufacturer to the bathtub manufacturer. The flat containers are easily folded and secured around the bathtubs. The availability of corrugated paperboard exceeds that of wood, and because the cleated paperboard container uses much less wood than wirebound containers, supply pressures are reduced. Wood cleating can be cut away from the corrugated paperboard body, which can then be bailed for sale to corrugated recyclers and remanufacture into paperboard. The volume of remaining wood to be disposed of is far less than that of a wirebound container. Such wood cleats can be used as garden stakes or kindling in contrast with the essentially unrecyclable wirebound container.

The principles, preferred embodiments, and modes of operation of the present invention have been described in the foregoing specification. The invention is not to be construed as limited to the particularly forms disclosed because these are regarded as illustrative rather than restrictive. Moreover, variations and changes may be made by those skilled in the art without departing from the spirit of the invention as described in the following claims.

What is claimed is:

1. A cleated corrugated paperboard container for enclosing a cast iron bathtub having a well with a rim surface extending around an opening of the well and an apron extending along side of the well from an edge of the rim, comprising:

a blank of corrugated paperboard scored to define a top panel, an apron panel, a bottom panel, and a well panel as a series of panels and a manufacturers joint foldably joined together along the respective scores, the blank having two side edges, a leading edge, and a trailing edge; and a pair of cleats rigidly attached to the side edges each of the panels in the series of panels, whereby a plurality of cleats are longitudinally aligned on the side edges of the blank, each cleat having a pair of longitudinal ends which are cut for mating engagement with the end of the adjacent cleat upon folding the blank on the scores, whereby the blank, being folded on the scores after the bathtub is placed rim down on the bottom panel of the blank, encloses the bathtub in a corrugated paperboard container which is closed by securing the manufacturers joint to a portion of the top panel adjacent the trailing edge of the blank.

2. The cleated corrugated paperboard container as recited in claim 1, wherein the direction of corrugations of the blank is parallel to the trailing and leading edges of the blank.

3. The cleated corrugated paperboard container as recited in claim 1, wherein the blank includes elongated strips of reinforcement tape imbedded between layers of the blank of corrugated paperboard, the strips disposed in a portion of the blank adjacent the side edges.

4. The cleated corrugated paperboard container as recited in claim 1, further comprising a joint cleat rigidly attached to the top panel along the trailing edge of the blank whereby staples are driven through the manufacturer's joint into the joint cleat to secure the blank as a wrapped covering around the tub.

5. The cleated corrugated paperboard container as recited in claim 1, further comprising a pair of rim-support pads, each rigidly attached to the bottom panel and abutting an inner side of a respective one of the cleats, whereby the rim surface of the tub, being received on the rim-support pads, is cushioned in the container.

6. The cleated corrugated paperboard container as recited in claim 1, further comprising a pair of apron pads spaced-apart and rigidly attached to the apron panel for cushioning the apron of the bathtub held within the folded blank.

7. The cleated corrugated paperboard container as recited in claim 1, further comprising a pair of feet pads spaced-apart and rigidly attached to the top panel such that a surface of the respective feet pads contacts a foot extending outwardly from a bottom surface of the well of the bathtub held within the folded blank container, for restricting the feet of the bathtub from punching through the top panel of the blank.

8. The cleated corrugated paperboard container as recited in claim 1, wherein the top panel defines at least one opening for inspection of the bathtub enclosed within the folded blank.

9. A cleated corrugated paperboard container for enclosing a cast iron bathtub having a well with a rim surface extending around an opening of the well and an apron extending along side of the well from an edge of the rim, comprising:

a blank of corrugated paperboard scored to define a top panel, an apron panel, a bottom panel, and a well panel as a series of panels and a manufacturers joint foldably joined together along the respective scores, the blank having two side edges, a leading edge, and a trailing edge, the blank including elongated strips of reinforcement tape imbedded between layers of the blank of corrugated paperboard and disposed in a portion of the blank adjacent the side edges;

a pair of cleats rigidly attached to the side edges each of the panels in the series of panels, whereby a plurality of cleats are longitudinally aligned on the side edges of the blank, each cleat having a pair of longitudinal ends which are cut for mating engagement with the end of the adjacent cleat;

a pair of rim-support pads, each rigidly attached to the bottom panel and abutting an inner side of a respective one of the cleats;

a pair of apron pads spaced-apart and rigidly attached to the apron panel for cushioning the apron of the bathtub held within the folded blank;

a joint cleat rigidly attached to the top panel along the trailing edge of the blank whereby staples are driven through the manufacturer's joint into the joint cleat to secure the blank as a wrapped covering around the tub; and a pair of feet pads spaced-apart and rigidly attached to the top panel such that a surface of the respective feet pads contacts a foot extending outwardly from a bottom surface of the well of the bathtub held within the folded blank container, for restricting the feet of the bathtub from punching through the top panel of the blank, whereby the blank, being folded on the scores after the bathtub is placed rim down on the rim-support pads, encloses the bathtub in a corrugated paperboard container which is closed by securing the manufacturers joint to a portion of the top panel adjacent the trailing edge of the blank.

* * * * *